US006472963B1

(12) United States Patent
Liu et al.

(10) Patent No.: US 6,472,963 B1
(45) Date of Patent: Oct. 29, 2002

(54) ALTERNATING CURRENT CONTACTOR

(75) Inventors: Chuanting Liu; Xiaoming Yang; Henming Yan; Yinghao Li, all of Yueqing (CN)

(73) Assignee: Chint Group Corporation, Yueoing (CN)

( * ) Notice: Subject to any disclaimer, the term of this patent is extended or adjusted under 35 U.S.C. 154(b) by 0 days.

(21) Appl. No.: 09/752,394

(22) Filed: Dec. 28, 2000

(30) Foreign Application Priority Data

Feb. 17, 2000 (CN) ..... 00203825 U

(51) Int. Cl.[7] ..... H01H 67/02
(52) U.S. Cl. ..... 335/132; 335/202
(58) Field of Search ..... 335/131–2, 202; 200/293–308

(56) References Cited

U.S. PATENT DOCUMENTS 4,710,740 A * 12/1987 Dennison ..... 335/248
4,724,410 A * 2/1988 Degenhart ..... 335/132

* cited by examiner

*Primary Examiner*—Lincoln Donovan
(74) *Attorney, Agent, or Firm*—Collard & Roe, P.C.

(57) ABSTRACT

The utility model discloses an alternating current contactor, including a foundation-support and a pedestal. A yoke iron on which mounts a coil unit is set inside the said foundation-support, and an armature iron and a contact unit are set in the said pedestal. The characteristics are that one side of the said foundation-support is open, and the coil unit and the yoke iron are constituted into a whole via a supporting board and buffer springs, and then it is fixed on the convex face of pulling part of the said foundation-support. A baffle plate with openings is on the top of the foundation-support, and a repelling force spring is installed between the baffle plate on the top of the foundation support and the armature iron. The coil unit can be easily inserted into or pulled out from the opening of the foundation-support, so that either repairing or replacing the coil unit become rather convenient.

2 Claims, 3 Drawing Sheets

ALTERNATING CURRENT CONTACTOR

BACKGROUND OF THE INVENTION

1. Field of the Invention

The utility model relates to an alternating current contactor.

2. The Prior Art

The prior alternating current contactor is constructed with a foundation-support and a pedestal. The yoke (iron), having a coil rack thereon, is located inside the said foundation-support. Coils are circled on the coil rack. An armature and a contact unit exist in the said pedestal. A spring is placed between the coil rack and the armature. The foundation-support is fixed to the pedestal by using screws. After the coil is electrified, an alternative magnetic field is established in the yoke iron, and then the armature is drawn to the yoke iron by the action of electromagnetic force. As a result, a contact tip will be driven to work. Having been cut off power supply of the coil, the armature would rebound to the initial position under the action of spring tension. since electromagnetic unit is fastened within the foundation-support and the pedestal, it is inconvenient to repair or replace the alternating current contactor.

SUMMARY OF THE INVENTION

The aim of the utility model is to provide a kind of alternating current contactor in which electromagnetic unit can be mounted and dismounted easily.

The aim of the utility model can be achieved in such a way: an alternating current contactor including a foundation-support and a pedestal, a yoke iron is set inside the said foundation-support, a coil unit mounted on the yoke iron, and an armature iron and a contact unit in the said pedestal. The characteristics are that one side of the said foundation-support is open, and the coil unit and the yoke iron are constituted into a whole via a supporting board and buffer springs, and then it is fixed on the convex face of pulling part of the said foundation-support. A baffle plate with openings is on the top of the foundation-support, and a repelling force spring is installed between the baffle plate on the top of the foundation support and the armature iron.

As a further improvement for the utility model, the said foundation support is connected with the said pedestal in a clipping-button way.

Because the alternating current contactor has the above mentioned structure, the pedestal and both the armature iron and springs therein are constructed as one independent unit in relative fixed form. On the other hand, the yoke iron, coil rack, coils, and supporting board are composed into another unit of yoke iron coil in relatively determined form. The latter unit is put into the foundation-support through the opening on one side of the foundation-support. Therefore, in need of repairing the unit and replacing coils therein, this unit can be easily pulled out through the opening without opening the pedestal. Since buffer springs are set between the supporting board and the coil rack, the coil rack can perform a relative motion in the axis. When the unit is placed into the foundation-support, the buffer springs will push the top end of the coil up to the top baffle plate of the foundation-support, which makes the unit of yoke iron and coil positioned inside the foundation-support reliably.

For the convenience of repairing, maintaining, and replacing the pedestal and the components located in it, the foundation-support is connected with the pedestal by using clipping buttons.

BRIEF DESCRIPTION OF THE DRAWINGS

The utility model will be further described by referring to an embodiment and drawings as following.

DETAILED DESCRIPTION OF THE PREFERRED EMBODIMENT

Figure 1:
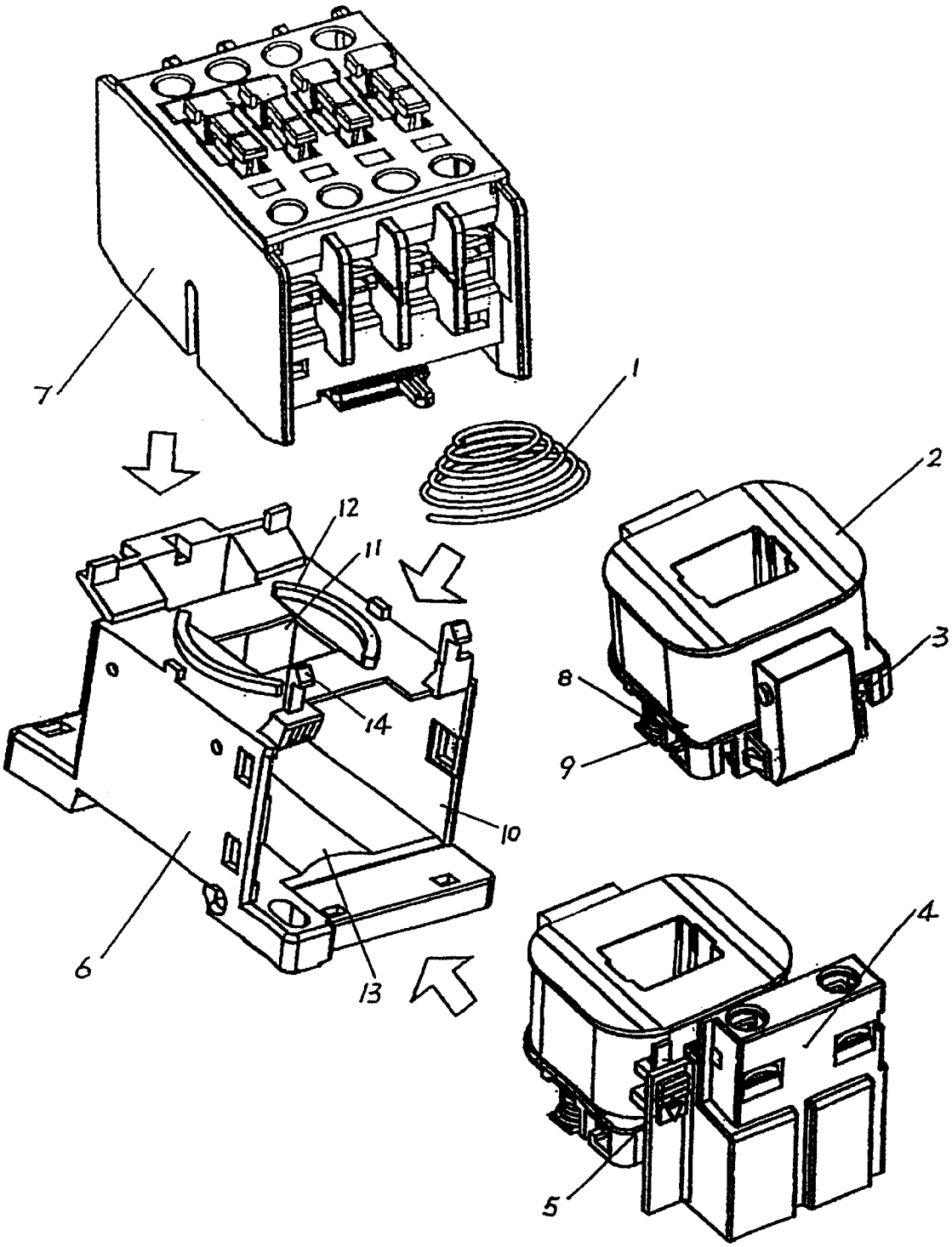
FIG. 1 is a configuration view showing the unit according to the utility model.

Referring to FIG. 1, an alternating current contactor includes a foundation-support 6 and a pedestal 7. There are two shackles 14 at the apex point of the foundation-support. After inserting two shackles into the pedestal and then fastening them with a strap ring, the foundation-support is reliably connected with the pedestal. There has an E-type yoke iron 3 with a coil 2 thereon in the said E-type yoke iron. An E-type armature iron 20 and a contactor Unit are installed within the said pedestal. The yoke iron is matched with the armature in shape and in relative position. The said foundation-support with the opening on its one side 10 takes a cubic shape. Its top baffle plate is provided with three square openings 11 for the armature iron's passing. There is a pair of circular arc convexities 12 on the outer side of the square opening located in the middle of the baffle plate. A repelling spring i is placed between the two convexities. The coil and the yoke iron are configured into a unit by using of a supporting board 9 and buffer springs 8, and then the unit is mounted on the convex surface 13 of pulling part of the foundation-support.

Figure 2:
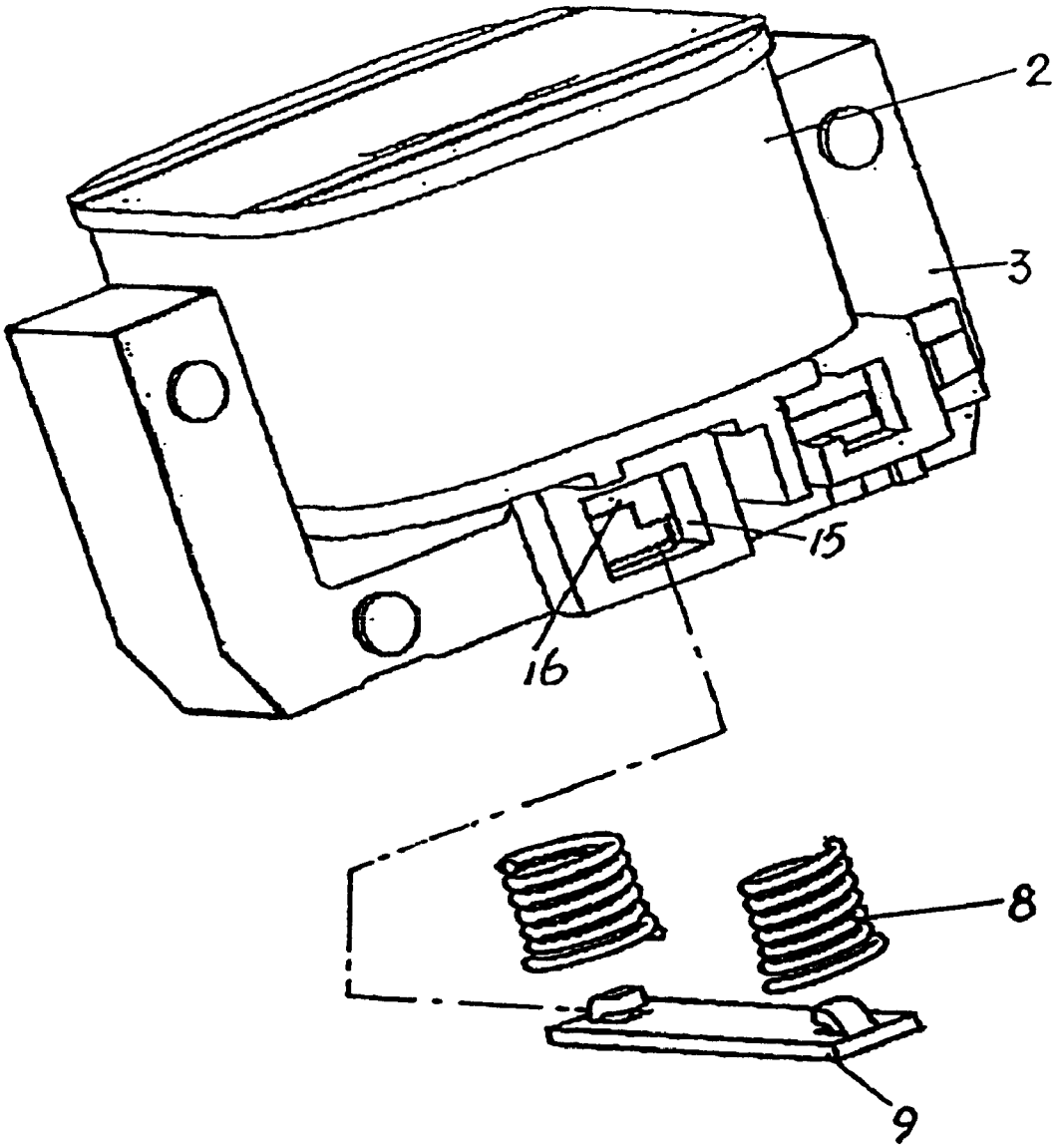
FIG. 2 is a configuration view showing the unit of yoke iron and coil according to the present invention.
Figure 3:
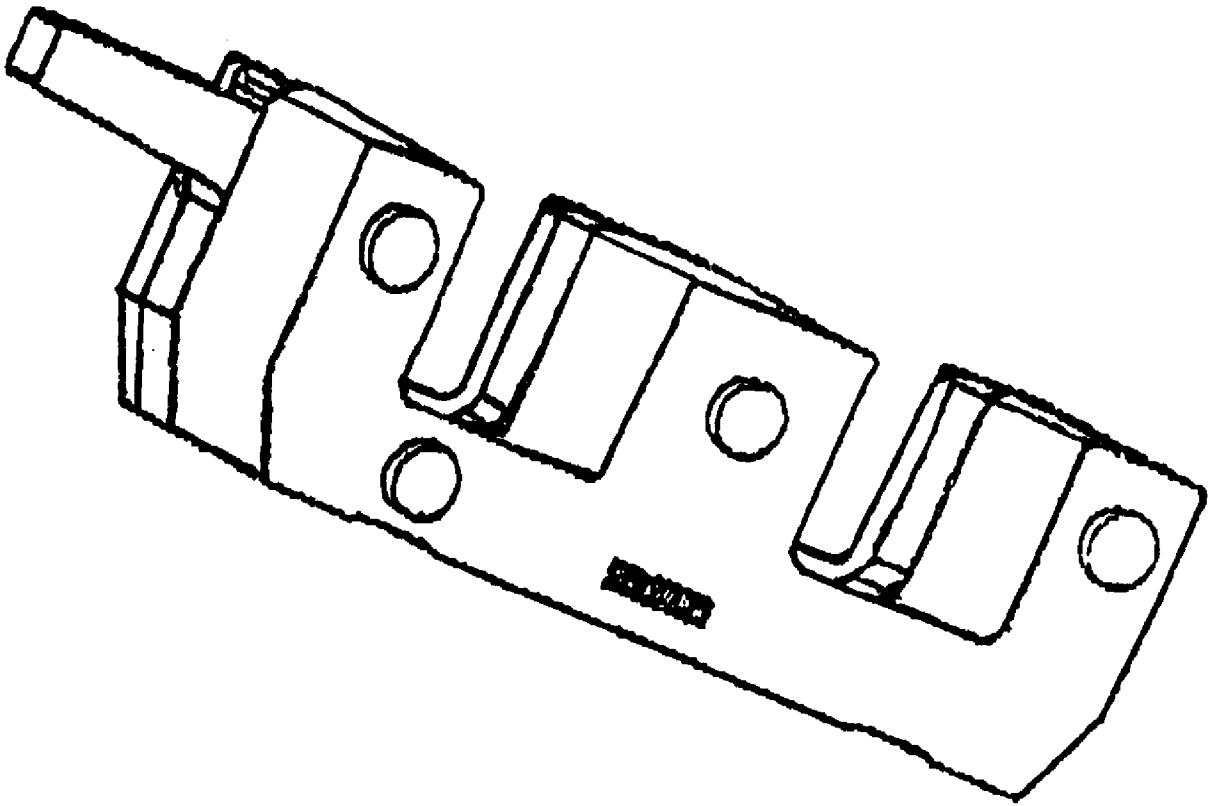
FIG. 3 is a view of the armature iron, which is disposed within the pedestal.

With reference to FIG. 2 showing the configuration of coil 2, there is a socket 15 on the foundation-support and a relative socket 16 on the bottom of yoke iron 3. The supporting board 9 can be inserted into the sockets, buffer springs are pressed between the supporting board and coils. Having been assembled, the yoke iron can move 1~2 mm upwards or downwards. The assembled unit of coil and yoke iron is inserted into the foundation-support 6. The unit of yoke iron and coil is made up of the yoke iron and coil under the action of buffer springs in a relative fixed way. With the coil being electrified, the iron core will generate magnetic flux, and the armature iron will be actuated. The yoke iron under the action of strong pulling force can move 0.8~1.2 mm upwards. The yoke iron, actuated completely by the armature iron, will take the armature iron together back to the original position of the yoke.

In order to keep good actuation performance of alternating current :ontactor at electrical current value over zero, noiseless and saving energy resources, the product uses the automatic control switch device disclosed by Chinese Patent Publication No. 972434194. The automatic control switch is put in the case 4. The automatic control switch is in on or "off" state via the mechanical motion of the armature iron to achieve high-voltage strong magnetizing. After closing the iron core, the maintaining state of low-voltage direct current is obtained automatically.

The alternating current contactor according to the utility model has the advantages of saving power supply and being used in wide voltage range.

Description of the connection between the automatic control switch device and the unit of yoke iron and coil: Two lead wires of the automatic control switch device are inserted into wiring clips of the coil, which makes the automatic control switch device and the unit of yoke iron and coil assembled into a whole. The automatic control switch device is equipped with the fastening button 5 at one side of its case. When the unit of yoke iron and coil is put into the foundation-support, the automatic control switch device is located in the opening position. Having clasped the fastening button, the automatic control switch device together with the unit or yoke iron and coil are reliably fastened inside the foundation-support.

What is claimed is:

1. An alternating current contactor comprising:

a foundation-support having one side open;

a pedestal connected to said foundation support;

a yoke iron disposed within the foundation support;

a coil unit mounted on the yoke iron;

a baffle plate with openings disposed on a top side of said foundation support;

an armature iron and a contact unit disposed within said pedestal; and a repelling force spring installed between the baffle plate and the armature iron, wherein the coil unit and yoke iron comprise a single unit connected via a supporting board and buffer springs, said single unit being fixed on a convex face of the foundation support.

2. An alternating current contactor according to claim 1, wherein said foundation support is connected with said pedestal via clipping-buttons.

* * * * *